United States Patent [19]

Cox et al.

[11] 4,346,886

[45] Aug. 31, 1982

[54] VARIABLE RESISTANCE EXERCISING DEVICE

[75] Inventors: Alan W. Cox, Bray; Paul N. Rainey, Kingston-upon-Thames, both of England

[73] Assignee: Black & Decker Inc., Newark, Del.

[21] Appl. No.: 156,509

[22] Filed: Jun. 4, 1980

[30] Foreign Application Priority Data

Jun. 4, 1979 [GB] United Kingdom ..... 7919375

[51] Int. Cl.[3] ..... A63B 21/00

[52] U.S. Cl. ..... 272/72; 272/70; 272/133; 272/DIG. 5

[58] Field of Search ..... 272/134, 132, 133, 131, 272/DIG. 3, 140, 138, 135, 142, 72; 267/69; 188/65.5, 65.4, 65.3; 66/146; 242/75; 226/195

[56] References Cited

U.S. PATENT DOCUMENTS

| | | | |
|---|---|---|---|
| 3,544,105 | 12/1970 | Latta | 272/133 |
| 4,010,948 | 3/1977 | Deluty | 272/133 |
| 4,284,272 | 2/1979 | Evans et al. | 188/65.4 X |

FOREIGN PATENT DOCUMENTS

| | | | |
|---|---|---|---|
| 861954 | 1/1971 | Canada | 272/133 |
| 601058 | 8/1934 | Fed. Rep. of Germany . | |
| 2756195 | 7/1978 | Fed. Rep. of Germany . | |
| 2812227 | 10/1978 | Fed. Rep. of Germany . | |
| 2010101 | 6/1979 | United Kingdom . | |
| 2012599 | 8/1979 | United Kingdom . | |
| 2014052 | 8/1979 | United Kingdom . | |
| 2027598 | 2/1980 | United Kingdom . | |

*Primary Examiner*—Richard C. Pinkham
*Assistant Examiner*—William R. Browne
*Attorney, Agent, or Firm*—Walter Ottesen; Edward D. Murphy; Harold Weinstein

[57] ABSTRACT

An exercising machine in which a belt is movable by a user against a minimum resistance has a user operated control to enable a user to increase that resistance. The belt passes round a series of rollers one or more of which can be locked against rotation by a system of pawls and ratchets or by resilient bushes. A single operating control may be used to actuate the pawls, the position of the control determining the number of rollers that are locked. For certain kinds of exercising machine, the rollers are locked against rotation in one direction only and are freely movable in the other direction. For other kinds of machine, the rollers are locked against movement in both directions.

16 Claims, 10 Drawing Figures

VARIABLE RESISTANCE EXERCISING DEVICE

Figure 1:
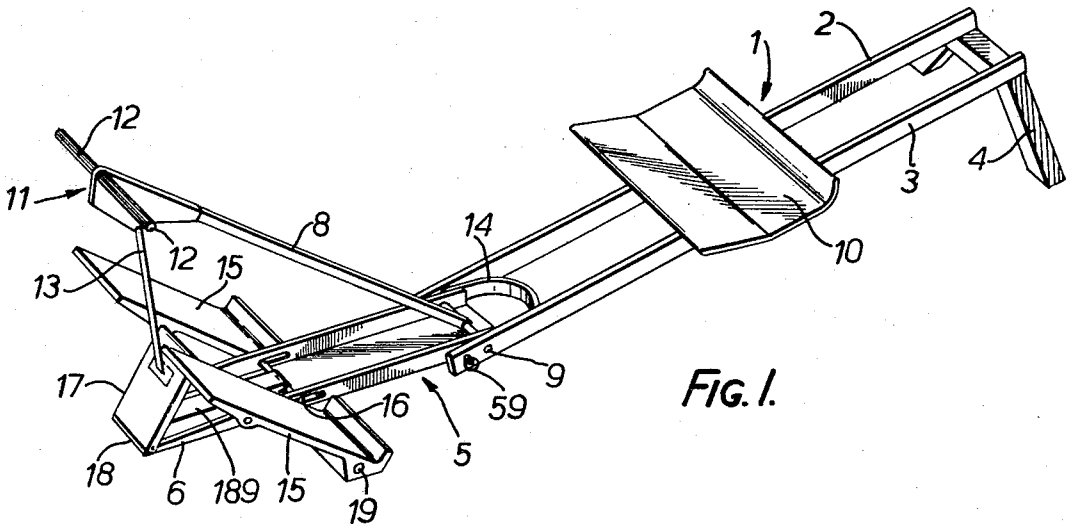

This invention relates to a variable resistance exercising device. Such a device can be used as an exercising device by itself, or it can be incorporated in exercising devices simulating a particular form of exercise, for example rowing, cycling or walking uphill.

Exercising devices that simulate a particular for of exercise are known. Some of such devices incorporate an arrangement for varying the degree of effort that must be exerted by a user to use the device effectively whilst in others no such arrangement is provided. Where it is possible to vary the degree of effort, the arrangement provided does not enable a user readily to grade the degree of effort in a repeatable manner so as to enable him to change by regular and known amounts the degree of effort that he must exert. It is not, therefore, possible to obtain the maximum benefit from such devices.

For example, forms of exercising devices are known in which a flexible member such as a rope is wound helically round a rod or tube of constant transverse cross section and the resistance to movement of the rope is changed by varying the number of turns of rope on the rod or tube. Certain of these forms have means for rotating the rod or tube and for indexing the rotation. The constructions are complicated and in general such devices are not suitable for incorporation in those forms of exercising devices that simulate particular forms of exercise.

Accordingly, it is an object of the present invention to provide an exercising device that is of simple construction and in which it is possible easily to vary the degree of effort to be exerted by a user of the device.

That object is achieved by providing the exercising device with a plurality of free-running, rotatable surfaces round or over which passes a flexible, elongate member, and means for locking at least one of the surfaces against rotation.

The continuous, rotatable surface may be that of a roller or a pulley, the exact shape depending upon the type of flexible elongate member employed. For example, if the elongate member is of strip-like form, the rotatable surface may be provided by a rotatable roller. However, if the elongate member is a rope or cable, a pulley may be more appropriate providing, as it does, a guiding surface for the rope or cable.

The rotatable surface of both rollers and pulleys is, of course, continuous.

Where more than one rotatable surface is lockable against rotation, it is preferred that each such surface shall be lockable individually as this increases the number of changes that can be made in the degree of effort required to be exerted. Alternatively, it is, of course, possible to lock selected groups of surfaces each group consisting of two or more rotatable surfaces.

The flexible member may pass round or over other free-running rotatable surfaces which are not provided with locking means. The other rotatable surfaces are so positioned that they ensure a desired lap angle between the flexible member and the free-running rotatable surfaces fitted with locking means, the angle being selected in such manner that, on locking the rotatable surface, a predetermined increase in resistance to movement of the flexible member is obtained.

In certain forms of exercising device, the lockable rotatable surfaces may be required to exert resistance to movement of the flexible member in one direction only. In such cases, the lockable rotatable surfaces have locking mechanisms that lock the rotatable surface against rotation in one direction but permit free rotation in the opposite direction. For example, the locking mechanism may include a ratchet and pawl drive.

Figure 2:
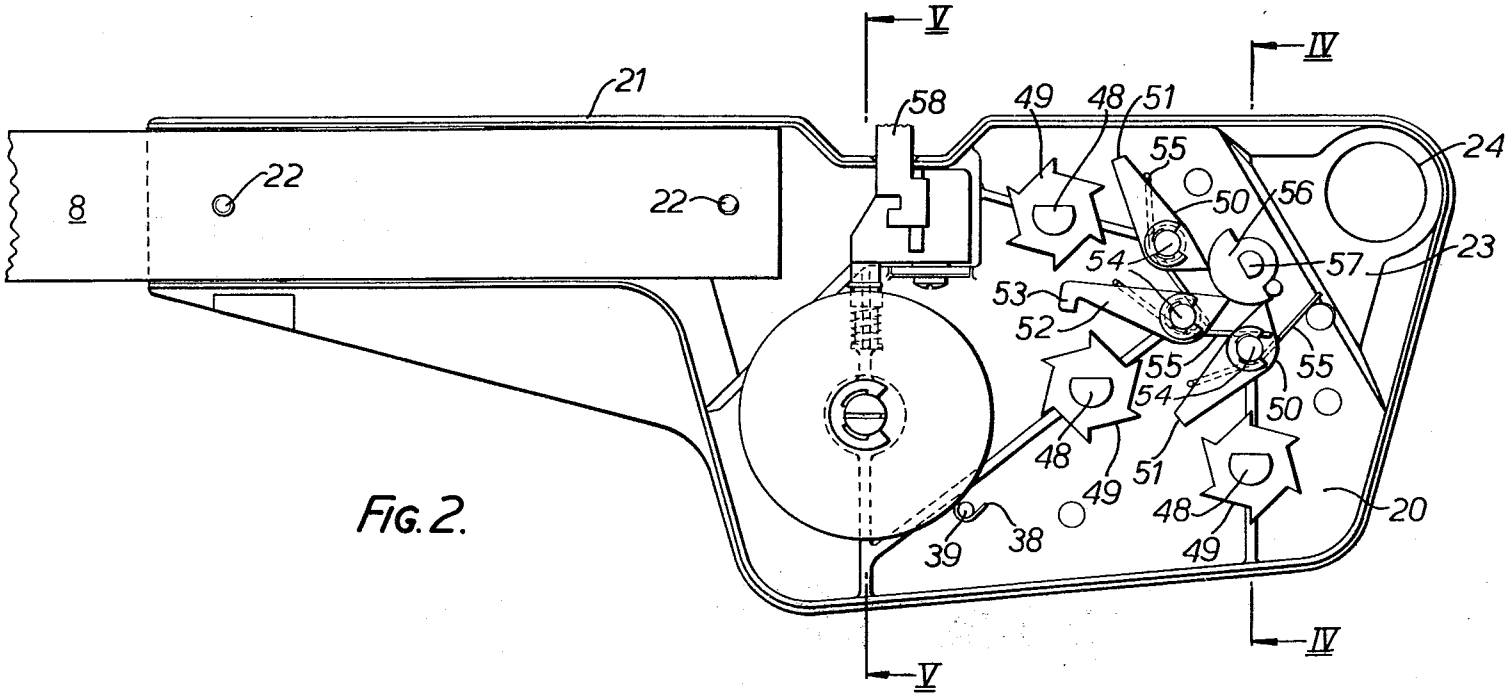
Figure 3:
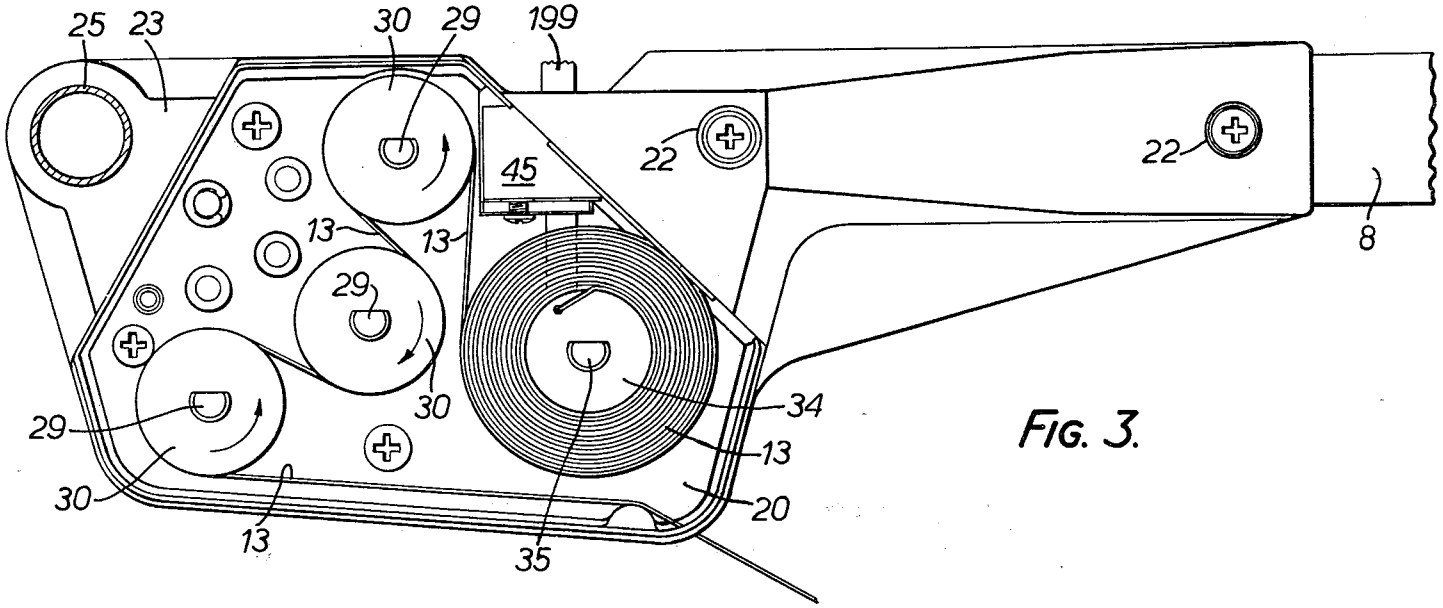
Figure 4:
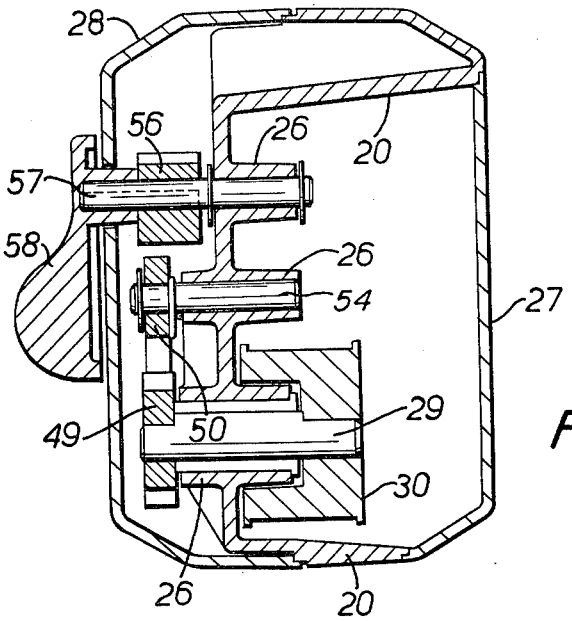
Figure 5:
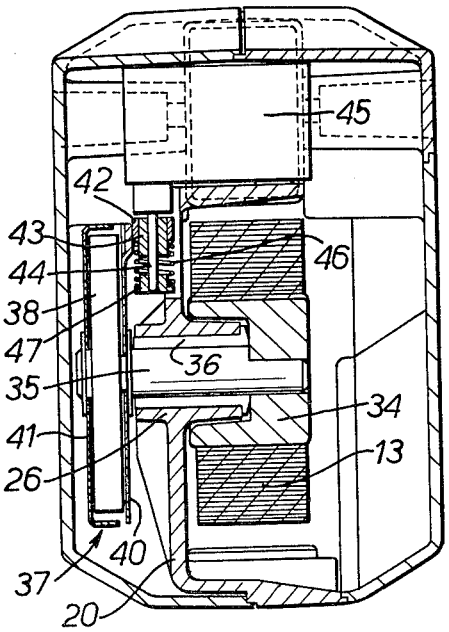
Figure 6:
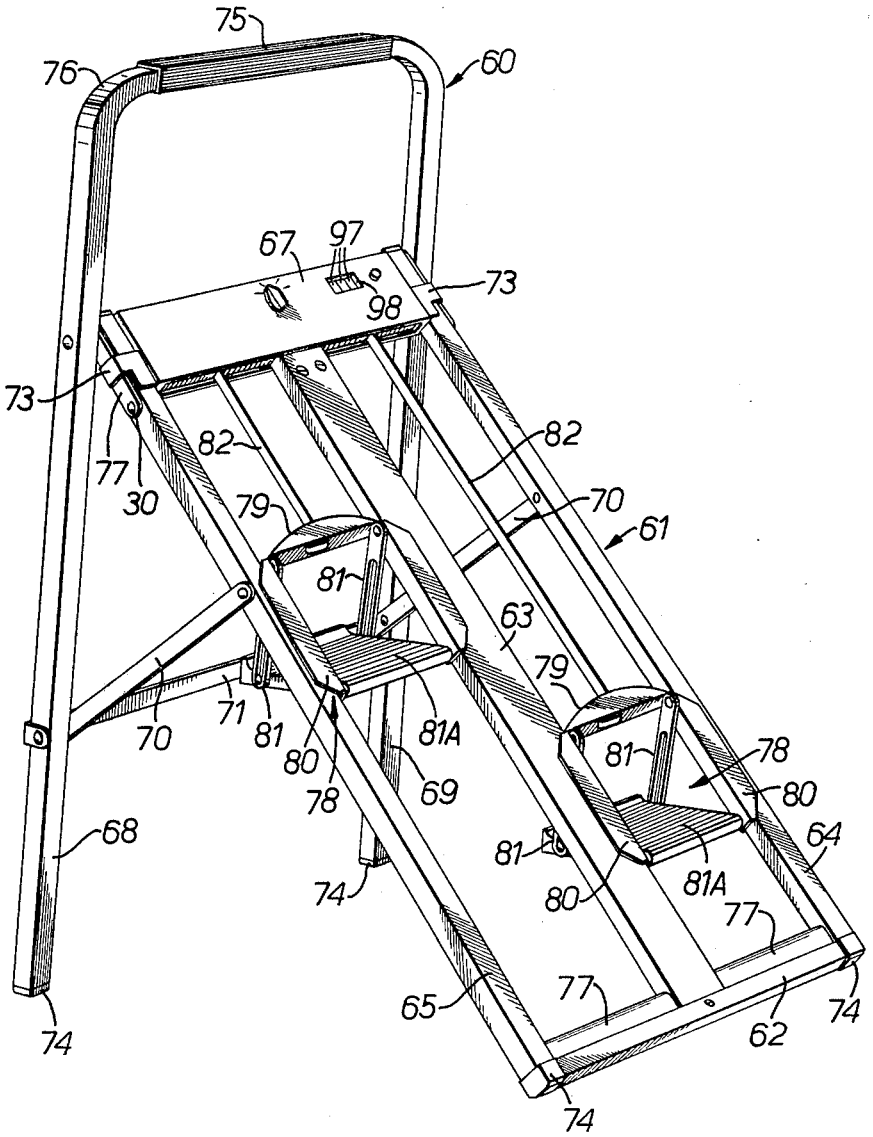
Figure 7:
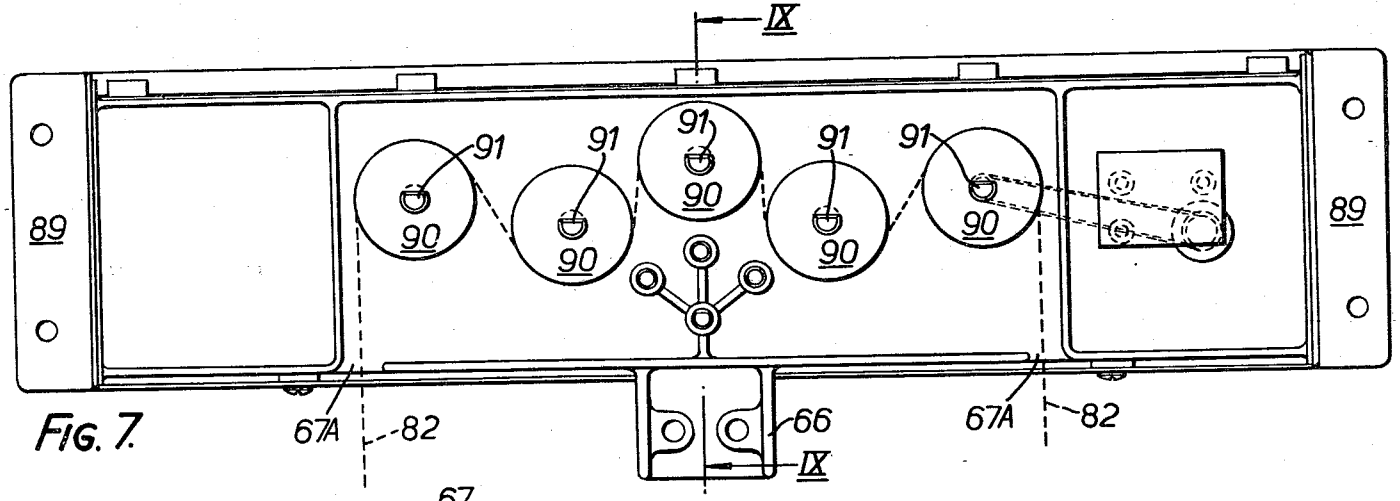
Figure 8:
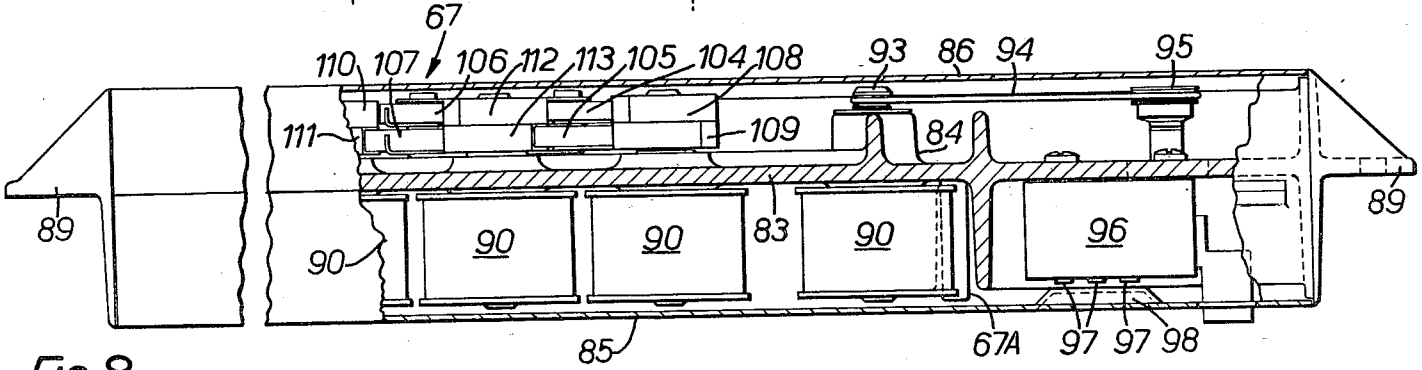
Figure 9:
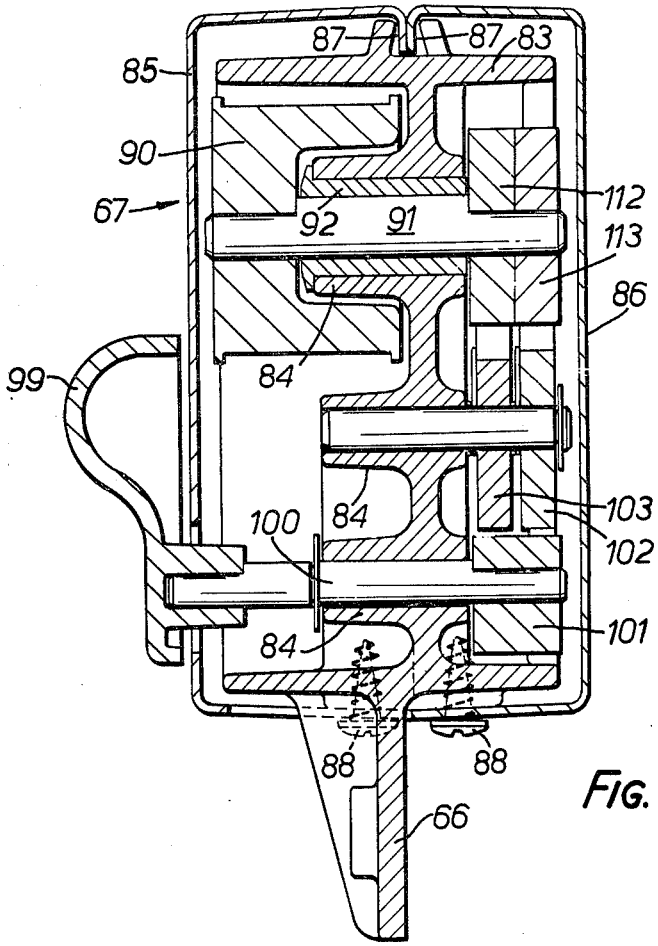
Figure 10:
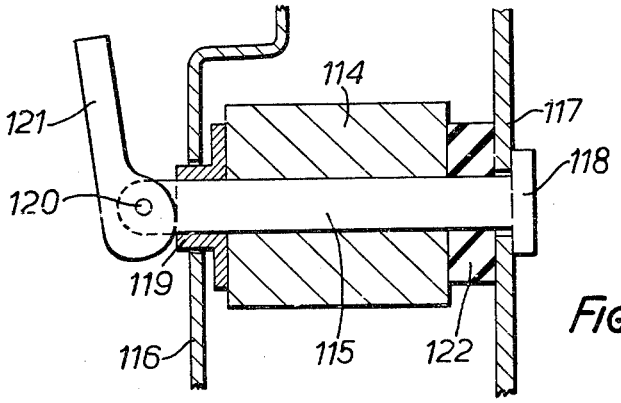

By way of example only, embodiments of the invention will now be described in greater detail with reference to the accompanying drawings of which:

FIG. 1 is a perspective view of a first embodiment,

FIG. 2 is a view from one side of a part of the first embodiment with a cover removed, FIG. 3 is a view from the other side of the part shown in FIG. 2 again with a cover removed, FIGS. 4 and 5 are, respectively, sections on the lines IV—IV and V—V of FIG. 2, FIG. 6 is a perspective view of a second embodiment, FIG. 7 is a front view of part of the second embodiment with a cover removed, FIG. 8 is a top view partly in section of the part shown in FIG. 7, FIG. 9 is a section on the line IX—IX of FIG. 7, and, FIG. 10 is a schematic side view of an alternative form of roller locking mechanism.

FIG. 1 shows in perspective an exercising machine simulating a rowing action. The machine has a main body member 1 comprising two elongate seat rails 2, 3 supported at one end between a rear support member 4 and a forward head member 5 comprising a 'U' channel member 6 pivotally secured between the seat rails 2, 3 at 9. When erected as shown in FIG. 1, the rails 2, 3 are downwardly inclined from the support 4 to the head member 5. The limbs of the 'U' channel member 6 are spaced apart to accommodate an "oar" arm 8 itself also pivotally secured at 9 between the limbs of the member 6 and the seat rails 2, 3.

Freely movable to and fro along the rails 2, 3 is a seat 10 on whose undersurface wheels are mounted that move along the rails.

The oar arm 8 has a housing 11 adjacent its outer end and from which extend hand grips 12 by which a user operates the machine as will be described in more detail below.

The housing 11 encloses means for varying the degree of resistance to movement of the oar arm 8 when pivoted in a clockwise direction by a user. From the housing 11 extends a belt or strap 13 one end of which is removably attached by means of a suitable buckle to a foot rest stay 17.

The member 6 extends forwardly from the seat rails 2, 3 when the machine is set up for use and the underside of the member 6 acts as a foot on which the forward end of the machine rests. A carrying handle 14 is fixedly attached to the member 6.

Each limb of the channel member 6 has mounted on it a foot rest 15 of approximately rectangular form when seen in plan and pivoted at one end in a short slot 16 in the arm and pivotally attached at its other end to the foot rest stay 17 that extends to a pivot 18 on the member 6. At the end adjacent the slot 16 each foot rest 15 has a short extension 19 that rests on the ground to give greater stability to the forward end of the machine.

The housing 11 comprises a casting 20 having an elongate channel extension 21 in which is received the outer end of the oar arm 8 and to which the extension is secured by self-tapping screws 22. The casting 20 also has a web 23 with an aperture 24 through which extends a tube 25 carrying the hand grips 12 referred to above.

The casting 20 is formed with a series of hollow bosses 26 which support the axles of other components described below. Protective covers 27, 28 fit over the sides of the casting 20 to conceal those other components. Cover 28 has an extension that co-operates with the extension 21 of the casting to enclose the outer end of the oar arm 8.

Rotatably mounted in three of the bosses 26 are the shafts 29 of rollers 30 round which passes the belt 13 whose other end portion is wound round a spool 34, the other end of the belt 13 being secured to the core of the spool 34. The spool 34 is carried by an axle 35 one of whose end portions is cut-away as shown in FIGS. 3 and 5 to prevent rotation of the spool 34 relative to the axle. The axle 35 is rotatably supported in a plain bearing sleeve 36 secured in the boss 26 and extends through the latter to carry on its other end portion a two part disc-like housing 37 within which is located a coil spring 38. One end of the spring 38 is hooked round a lug 39 extending from the casting 20 while the other end of the spring is fixed to the axle 35.

The two-part housing 37 includes an inner circular cover plate 40 that rotates with the axle 35, the other part 41 of the housing 37 being fixed in position. Over a portion of its periphery, the plate 40 has a raised arcuate surface 42 in engagement with a roller 43 faced with a friction material. The roller 43 is rotatable upon the drive shaft 44 of a counter 45 and is connected to that shaft by means of a spring clutch 46 between the roller 43 and a collar 47 fixed to the shaft 44.

Some of the remaining bosses 26 support shafts 48 carrying ratchet wheels 49 and, as can be seen from FIG. 2, the ratchet wheels are all of the same construction but the centre wheel is mounted the opposite way round so as to be of opposite hand to the other two. Co-operating with the ratchet wheels 49 are pawls which are not all of the same configuration. Pawls 50 have flat ends 51 but pawl 52 has a hooked end 53. The pawls are pivotally mounted upon shafts 54 mounted in others of the bosses 26.

The pawls 50 and 52 are urged by springs 55 into contact with a cam 56 on a shaft 57 rotatably mounted in another boss 26. Shaft 57 extends through the cover 28 when the latter is in position and an operating lever 58 is secured to the outer end of the shaft.

As shown in the drawings circlips are used where required to hold components on shafts and spacing washers are included where desirable.

The spring 38 is so arranged that it urges axle 35 and hence spool 34 to rotate in an anti-clockwise direction as seen in FIG. 3 thereby tending to coil up the belt 13 on the spool 34 and to hold the oar arm 8 in a downward position with the hand grips 12 close to the foot rests 15. The spring applies a tension of some 2 to 10 lbs. to the belt thereby keeping in contact with the surfaces of the rollers 30.

To use the apparatus shown in FIG. 1 a user seats himself on the seat 10 which he slides down the rails 2, 3 towards the head member 5. With his legs bent, he places his feet in the foot rests 15 and if desired straps his feet to the rests by webbing straps (not shown). He then leans forward and grasps the handles 12 and pulls back straightening his legs thereby simulating a rowing action. During that action, the seat 10 slides along the rails 2, 3 towards the support 4.

When the user relaxes his pull on the oar arm 8, the latter pivots in an anticlockwise direction under the tension in the belt 13 and by bending his legs and allowing the seat 10 to slide down the rails 2, 3 away from the support 4, the user can retain his grip on the handle.

With the parts in the positions shown in FIG. 2, the rollers 30 are all free-running and offer no resistance to the movement of the oar arm 8. However, if the user now rotates the lever 58 from the zero position shown in FIG. 2 to a first position, cam surface 56 allows the lowermost spring 55 to rotate the lowermost of the pawls 50 shown in FIG. 2 in an anti-clockwise direction to bring the end 51 of the pawl into engagement with the lowermost ratchet wheel 49 thereby preventing rotation of the ratchet and associated shaft 48 and roller 30 (the lowermost as seen in FIG. 3) from rotating in an anti-clockwise direction as seen in FIG. 3. The belt 13 is thus pulled over the now stationary roller and this increases the pull that must be exerted by the user when he wishes to pull the oar arm 8 towards himself, i.e. clockwise.

However, when the user relaxes his pull on the oar arm 8, the roller is able to rotate because the pawl now rides freely over the teeth of the ratchet. Thus, the oar arm 8 returns under the tension in the belt 13.

By moving the lever 58 to its second position, a further increase in the pull that the user must exert to secure pivotal movement of the oar arm 8 in clockwise direction is obtained. In the second position, cam 56 has rotated from the position it previously occupied and the spring 55 of the centre pawl 52 rotates that pawl to bring the hooked end 53 into engagement with the centre ratchet of the ratchets shown in FIG. 2. This prevents rotation of the shaft 48 and other associated roller 30 in a clockwise direction as viewed in FIG. 3. Once again, however, the roller is allowed to rotate freely in the other direction so offering no resistance to movement of the belt 13 during anti-clockwise rotation of the oar arm.

A still further increase is obtained by rotating lever 58 to its third position thereby locking the uppermost roller 30 seen in FIG. 3 against rotation in an anti-clockwise direction only (as seen in FIG. 3).

Movement of the lever from its third position back through the second and first to the zero position produces a progressive decrease in the pull that has to be exerted by the user to effect clockwise movement of the oar arm. Such movement of the lever is not impeded by the pawls 50 and 52 because of movement of the latter that has taken place.

Adjustment of the position of the lever 58 can readily be effected by the user because the housing 11 is mounted at the upper end of the oar arm 8 and in this position is easily accessible to the user whilst sitting on the seat 10.

The counter 45 referred to above counts the number of "strokes" of the oar arm 8 i.e. the number of times the oar arm is pulled towards the user's body. The spring clutch 46 operates to drive the counter only when the belt 13 unwinds off the spool 34. A resetting button 199 enables a user to set the counter to zero before he uses the machine.

Thus, with all the rollers 30 unlocked and free-running in both directions of rotation resistance to clockwise movement of the arm 8 is low. As each roller is locked, it introduces a predetermined resistance to such movement of the arm. The resistance introduced is always the same each time a roller is locked so that the user can readily "grade" his use of the apparatus by known steps and in a repeatable manner.

Additionally, it will be appreciated that the use of a single control lever 58 considerably simplifies the mechanisms required and enables the user readily to see what level of resistance has been introduced.

The machine shown in FIG. 1 can readily be folded into a compact state for storage purposes when it is not required for use.

A hook 189 pivoted at the pivot 18 at the extreme front of the channel member 6 and hooked, in use, around the rod pivoting the foot rests 15 to the member 6 is lifted off the rod allowing the rod to slide rearwardly in the slots 16, lowering the foot rest stay 17 and the foot rests 15. The head member 5 is then released for movement by removing a locking pin 59 that locks the member 6 to the rails 2, 3 and pivoting the head member in an anticlockwise direction as viewed in FIG. 1 until it lies against the rails 2, 3. This brings into an accessible position the carrying handle 14 and allows the machine to stand unsupported on the rear support member 4 with the carrying handle at the top of the machine.

FIG. 6 is a perspective view of another exercising machine embodying the invention. The machine provides exercise that simulates the action of walking uphill.

When erected and ready for use, a one-piece main frame member 60 of inverted U-shape is supported in a near vertical position by side legs 64, 65 bridged at the bottom by a cross strut 62 from which extends a central guide 63 which extends between the legs 64, 65 and is connected at its upper (as seen in FIG. 6) end to a bracket forming part of the frame of a housing 67 mounted between the upper ends of the legs 64, 65.

Pivotally connected between the legs 64, 65 and the legs 68, 69 of the main frame member 60 are stays 70, there being a cross strut 71 between the legs 68, 69 at the height of the pivotal connection between the stays 70 and the legs 68, 69. Further connecting stays 77 are pivotally interconnected between the legs 64, 69 and 65, 68 being connected to legs 64, 65 at the level of the housing 67 when the machine is erected as in FIG. 6. In the erected position the stays 77 lie approximately along the line of the legs 64, 65 the pivotal connection to the latter being a small distance below the housing 67. Adjacent the stays 77 and secured to the legs 64, 65 are stops 73 whose function is described below.

To the lower ends of the legs 64, 65, 68 and 69 are secured feet 74 of a rubber, plastics or other suitable material, and a hand grip 75 is fitted to the "base" 76 of the main frame member 60.

The main frame member 60, the legs 64 and 65 and the guide 63 are all of box section metal. The cross strut 62 is an upwardly-open channel section in which buffers 77 of a resilient material, for example an oval sectioned tube of deformable plastics material, are disposed.

Movable up and down the member 61 in the gaps between the guide 63 and the legs 64 and 65 are steps 78 each comprising a U-shaped frame 79 with side flanges 80 which rest as shown on the upper surfaces of the legs and guide. Step surfaces 81A are pivoted at their fronts to the limbs of the frame 79 and at their inner ends in the slots in slotted links 81 pivotally secured as shown to the frames 79.

Interconnecting the steps 78 is a belt 82 of a woven nylon or other suitable material that passes upwardly from one step into the housing 67 through gaps 67A therein and then downwardly to the other step.

The housing 67 accommodates a main casting 83 of generally I beam form formed with a plurality of hollow bosses 84. Covers 85, 86 fit over the front and back of the casting 83, the covers having inturned flanges 87 which locate between upstanding lugs 88 on the casting. Screws 88 secure the undersides of the covers 85, 86 to the casting.

The covers 85, 86 enclose all the casting 83 with the exception of end flanges 89 and the bracket 66. The end flanges 89 connect the casting 83 to the legs 64, 65 while the bracket 66 connects the casting with the guide 63.

The belt 82 passes round a series of rollers 90 fixed to axles 91 rotatably mounted in plain sleeve bearings 92 located in associated bosses 84. As can be seen from FIGS. 7 and 9 the pulleys are fixed on semi-cylindrical end parts of the axles. The extreme left and extreme right pulleys of the rollers 90 are guide rollers only and are free running. The shaft of the extreme right hand roller carries a small pulley 93 coupled by a belt 94 to a second small pulley 95 that drives a counter 96 whose dials 97 are visible through an aperture 98 in the cover 85. A unidirectional clutch (not shown) ensures that rotation in one direction only of the pulley 95 is registered by the counter 96.

The remaining three centre rollers are also free running but can be selectively locked against rotation by a series of cam operated pawls and ratchets similar to those described above.

Control of rotation of the three central rollers is exercised by a lever 99 fixed to one semi-cylindrical end of axle 100 whose other semi-cylindrical end carries a cam 101 which actuates three sets of pawls each set consisting of two pawls. The pawls 102, 103 of one set are shown in FIG. 9. The pawls 104, 105; 106, 107 of the other two sets are seen in FIG. 8.

Mounted upon the axles 91 of the three centre rollers (as viewed in FIG. 7) are pairs of ratchets, the ratchets of a pair being mounted back to back so as to have opposite "hand". FIG. 8 shows the pairs of ratchets 108, 109; 110, 111; 112, 113 and FIG. 9 one pair comprising ratchets 112 and 113.

The lever 99 has a zero position in which all rollers are free-running and first, second and third positions in which, respectively, one roller 90 is locked against rotation in both directions, two rollers 90 are locked against rotation in both directions and three rollers 90 are locked against rotation in both directions. As will be apparent later it is necessary to lock the rollers 90 against rotation in both directions and this is achieved by the use of pairs of ratchets and pawls with each roller.

The contour of the cam 101 and the shape of the pawls 108 . . . 113 are similar to the contour of cam 56 and pawls 50 and 52 respectively. The shape of the pawl end is determined as before by the direction of rotation of the associated ratchet.

To use the machine after it has been erected into the position shown in FIG. 6, a user places one foot on one of the steps 78 and the other foot on the other step. By transferring most of his weight from the lower step to the higher one of the latter will slide to the bottom of the support frame 61, the descent being arrested gently by the resilient strip 77 which acts as a buffer. As the one step slides down, the other step slides up and the user then transfers most of his weight on to the other step now at the top of the support frame 61.

Thus, the user is able to simulate the action of walking up stairs. Alternatively, by supporting most of his bodyweight by his arms on the part 76 of the main frame, he is able to simulate a bicycling action.

The degree of resistance to the movement of the steps 78 is determined by the braking effect introduced by locking one or more of the lockable rollers 90 and this is readily achieved by simply rotating the lever 99 into the desired position. The lever 99 is easily accessible to a user as he stands on the machine. The user is thus able to "grade" his use of the machine in a controlled, repeatable fashion.

The counter 96 records the extent of use of the machine and indicates that extent to the user.

At the end of a period of use, the machine is folded up and can be stored away. The pivotal connections between the frame members 60, 61 and the stays 70 and 77 together with the length and deposition of the latter enable the frame member 61 to be pivoted into a vertical position in which the member lies within the main frame member, the stops 73 locating on the surfaces of the legs 68 and 69. The step surfaces 81 are also pivoted to lie in the plane of the U shaped slides 79.

Although preferred, it is not essential to employ a common control for operating the pawls for locking the rollers. Individual control levers or other control devices may be used instead.

If desired, the length of the strap may be made adjustable, for example by making one end of the strap attachable to a step at various positions away from the end of the strap. Adjusting the length of the strap alters the length of "step" during exercise—the longer the strap, the shorter the "step". Also a user can without changing the length of the strap shorten his "steps" merely by transferring his weight before the lower step reaches the buffer 77.

In addition, although the pawls and ratchets are preferred, other forms of locking device could be used and FIG. 10 shows, in schematic form only, an alternative form of roller locking mechanism.

FIG. 10 shows a single roller 114 only which is freely rotatable on an axle 115 carried between side plates 116 and 117. The axle 115 has a head 118 in contact with plate 117 and is supported at its other end in a stepped collar 119 mounted in an aperture in the other side plate 116. The end of the axle 115 projects from the collar 119 and has a diametral hole 120 through which passes a stub shaft 120 on which a cam lever 121 is rotatably mounted. Between the plate 117 and the adjacent end of the roller 114 is a disc 122 of high-friction, and preferably resilient, material, for example rubber.

With the components in the position shown in FIG. 10, the roller 114 rotates freely on axle 115. To lock roller against rotation, the lever 121 is rotated in an anticlockwise direction about the shaft 120 and the roller is forced to the right as viewed in FIG. 10 and into contact with and compressing the disc 122 between the end of the roller and the side plate 117 and thereby locking the roller against rotation. The lever 121 is rotated until it is in line with the axis of rotation of the roller in which position the lever is held against any movement by the reaction from the disc 122.

It will be appreciated that, with the locking mechanism shown in FIG. 10, the roller is locked against rotation in both directions. Thus the mechanism shown in FIG. 10 is suitable for use in the exercise machine shown in FIG. 6 but not in that shown in FIG. 1 where each roller must always be free to rotate in one direction.

We claim:

1. An exercising device comprising:

a housing in which is mounted a plurality of spaced apart rotatable surfaces;

a flexible, elongate member that passes into the housing, around the rotatable surfaces and out of the housing;

means for selectively and releasably locking at least one of the surfaces against rotation to enable a user of said exercising device to select in a repeatible manner different degrees of effort that must be exerted in using said device;

a framework, an arm having one end pivotally secured to said framework, said arm having said housing mounted thereon, and adjacent the other end thereof; and a take-up reel mounted in said housing and resiliently biased into a take-up action, the flexible elongate member being connected at one end to said framework and at the other end to said take-up reel.

2. An exercising device, comprising:

a housing;

a plurality of free-running spaced apart rotatable surfaces mounted in said housing;

a flexible elongate member passing into said housing, and around said rotatable surfaces;

first means for releasably locking one of said surfaces against rotation in at least one direction;

second means for releasably locking another of said surfaces against rotation in at least one direction; and a common operating control means having an associated cam movable thereby, said control means having a plurality of positions for selectively causing said cam to actuate said first and second means to enable a user of said exercising device to select in a repeatible manner different degrees of effort that needs to be exerted in exercising with said device.

3. An exercising device, comprising:

a frame for supporting said device on the ground;

at least one movable member mounted on said frame and movable relative thereto for exercising movement by a user of said device, said moveable member having a part to be physically engaged by the user to exert force directly thereon;

a housing connected to said frame;

at least three spaced apart rotatable surfaces mounted in said housing;

a flexible elongate member passing around and in contact with at least a portion of each of said rotatable surfaces, one end of said flexible member being connected to said one movable member externally of said housing;

means associated with each of said rotatable surfaces for selective releasable locking of said rotatable surfaces; and cam selection means having a number of positions for selectively actuating said locking means to enable the user of said device to select in a repeatible manner at least three different degrees of effort that needs to be exerted in exercising with said device.

4. The exercising device recited in claim 3, wherein said flexible member passes round said three rotatable surfaces in a path that causes consecutive rotatable surfaces to rotate in opposite directions when said locking means is inoperative.

5. The exercising device recited in claim 3, wherein said locking means comprises a ratchet and pawl mechanism associated with each rotatable surface, and said selection means operates a cam into contact with which all the pawls are resiliently urged.

6. The exercising device recited in claim 5, wherein said rotatable surfaces are rotatable about parallel axes, said pawls and said cam are rotatable about axes parallel to said axes of said rotatable surfaces, and the ratchets are mounted for rotation concentrically with their associated rotatable surfaces.

7. An exercising device, comprising:

a housing having mounted therein a plurality of rotatable surfaces;

a flexible, elongate member that passes into the housing 4 and round the rotatable surfaces;

means for selectively and releasably locking the rotatable surfaces against rotation; and a common control means, mounted on said housing, for selectively operating said locking means and having a plurality of control positions in each of which a different selection of one or more of the rotatable surfaces is locked against rotation;

whereby a user of said exercising device can readily select in a repeatible manner different degrees of effort that must be exerted in using said device.

8. An exercising device as claimed in claim 7 in which the locking means locks each said surface against rotation in both the clockwise and anticlockwise directions.

9. An exercising device as claimed in claim 8 in which each said surface is rotatably mounted upon a spindle and is movable axially along the spindle and in which the locking means includes a mechanism for moving each rotatable surface against a respective friction surface for locking the roller against rotation.

10. An exercising device as claimed in claim 9 in which the friction surface is that of a resilient bush that is compressed by the roller when locked against movement.

11. An exercising device as claimed in claim 8 in which each rotatable surface is associated with a ratchet and pawl mechanism adapted, when operated, to lock the surface against rotation in both directions.

12. The exercising device recited in claim 7, wherein said common control member has a zero position in which none of the rotatable surfaces are locked against rotation.

13. The exercising device recited in claim 7, wherein said locking means comprises a ratchet and pawl mechanism associated with one of said rotatable surfaces and adapted, when selectively operated, to lock said one surface against rotation in one direction and to permit rotation in the other direction.

14. The exercising device recited in claim 13, wherin said locking means comprises a plurality of ratchet and pawl mechanisms, one associated with each rotatable surface.

15. An exercising device as claimed in claim 14 in which the common control member is a pivotally mounted lever.

16. An exercising device as claimed in claim 15 in which the lever is mounted upon a shaft that also carries a cam, the pawls being resiliently biassed into contact with the cam.

* * * * *